United States Patent [19]

Larsen

[11] 4,190,196

[45] Feb. 26, 1980

[54] CENTRIFUGE TUBE CAP

[75] Inventor: Max J. Larsen, Woodbury, Conn.

[73] Assignee: E. I. Du Pont de Nemours and Company, Wilmington, Del.

[21] Appl. No.: 572,711

[22] Filed: Apr. 29, 1975

[51] Int. Cl.[2] ..... B04B 15/00; B65D 45/00

[52] U.S. Cl. ..... 233/26; 150/8; 220/319; 220/327; 233/1 A; 285/255

[58] Field of Search ..... 220/3, 66, 67, 83, 227, 220/315, 378, 237, 319; 277/115, 170, 171; 285/255, 421; 233/26, 1 A, 1 R, 27; 85/1.J P; 210/24; 23/292

[56] References Cited

U.S. PATENT DOCUMENTS

| | | | |
|---|---|---|---|
| 1,208,620 | 12/1916 | Moser | 85/1 JP |
| 2,200,082 | 5/1940 | Guarnaschelli | 285/255 |
| 2,846,126 | 8/1958 | Warren | 220/67 |
| 2,889,733 | 6/1959 | Vanderhoot | 85/32 R |
| 3,150,889 | 9/1964 | Watts | 277/115 |
| 3,258,279 | 6/1966 | Johnsen | 277/170 |
| 3,285,308 | 11/1966 | Stambaugh | 150/8 |
| 3,361,449 | 1/1968 | Parro | 285/25 S |
| 3,368,599 | 2/1968 | Dailey et al. | 150/8 |
| 3,417,899 | 12/1968 | Brown | 220/67 |
| 3,447,712 | 6/1969 | Galasso et al. | 220/237 |
| 3,459,369 | 8/1969 | Marks | 277/115 |
| 3,635,370 | 1/1972 | Aomanauskas | 220/315 |
| 3,847,819 | 11/1974 | Firth | 277/170 |
| 3,938,735 | 2/1976 | Wright et al. | 233/26 |

*Primary Examiner*—Allan N. Shoap

[57] ABSTRACT

Centrifuge tube cap has a plug which fits into the open end of the tube. A reduced diameter stud on the plug has an axial bore and extends outside of the tube thereby forming a shoulder at the lip of the tube. The peripheral portion of the shoulder is beveled. An annular cap is placed over the open tube end and stud portion of the plug and secured thereto by a nut which, when tightened, wedges the tube wall between the cap and the shoulder portion of the plug. The cap has a downwardly extending skirt whose inner wall is flared outwardly. This wedging action compresses the wall of the tube between the plug and the cap thereby forming a seal. A post fill screw is threaded into the central bore formed in the plug.

9 Claims, 3 Drawing Figures

CENTRIFUGE TUBE CAP

BACKGROUND OF THE INVENTION

This invention relates to a centrifuge container cap and, more particularly, to a centrifuge container cap which provides an improved cap compression seal.

Among the many types of centrifuges available are those wherein the centrifuge rotor is provided with a plurality of cavities arranged to receive containers or tubes in which samples are to be processed. When the centrifuge is in operation the sample material within the tubes is subjected to centrifugal forces according to the spin speed of the rotor. As the tube's contents are subjected to centrifugal force, there is the ever present problem of the tube's contents migrating upwardly and leaking around the tube cap. Any leaking fluids, of course, are ejected from the tube during the centrifuge operation.

Such leakage is a particular problem if the tubes are positioned with their axis in a vertical orientation. Partly for this reason, centrifuge rotors often are designed with their cavities oriented at an angle with respect to the rotor axis such that the bottom of the tube is at a greater radial distance from the spin axis than the top of the tube. Even with this positioning, since it is necessary to fill the tubes with the fluid up to the very top in order to prevent tube collapse, it is again apparent that sample tries to force its way out through or around the cap.

Accordingly, various caps have been designed for use with centrifuge tubes. These caps provide for a minimum air space and facilitate the complete and total filling of the tubes with a fluid such that the fluid itself acts as a support for the walls of the tube. It has become customary in recent years to use thin-walled plastic tubes for this purpose on a throwaway basis. It is characteristic of these prior art centrifuge caps to use O-rings, Quad X-rings and/or plastic washers for sealing purpose. Caps of this type are described for example in U.S. Pat. No. 3,459,369, issued Aug. 5, 1969 to Lloyd C. Marks, in U.S. Pat. No. 3,635,370, issued Jan. 12, 1972 to William A. Romanauskas, and U.S. Pat. 3,447,712 issued June 3, 1969 to Maurice Galasso et al.

While the caps provided by these patents have proven quite satisfactory, there have been instances in which some of the caps tend to leak. Such leaking, if it occurs, can ruin many days of work; or in the extreme situation, if harmful solutions are being used, possibly endanger the centrifuge operator. There is also a practical problem presented by the cap failure. In the extreme case the cap may become so distorted that it is incapable of disassembly. In this instance, the cap, which is reusable—only the tubes normally are thrown away—must be discarded.

A still further disadvantage of these prior art caps is that with the utilization of O-rings, washers and the like, the number of parts necessary to make a complete cap is increased and hence the cost of the cap is increased.

Accordingly, it is an object of this invention to obviate many of the disadvantages of the prior art centrifuge tube caps.

Another object of this invention is to provide an improved centrifuge tube cap.

A further object of this invention is to provide an improved centrifuge tube cap which is of relatively low cost.

SUMMARY OF THE INVENTION

Many of the above-noted disadvantages of the prior art centrifuge caps are obviated by the construction of a cap in accordance with this invention, which includes a plug adapted to be removably inserted into the open end of a centrifuge tube, a cap adapted to be detachably mounted on said plug with a depending annular portion extending at least partially over the outer surface of the wall of said tube, and means for wedging the wall of the tube between the plug and the cap thereby to form a seal. The wall of the tube is compressed between the plug and the cap by forming the interior of the annular portion with an outward flare such that at least a part of its interior diameter is less than the outside diameter of the tube.

In a particularly preferred embodiment the plug has a beveled shoulder which supports the tube wall against the compression forces of the flared annular portion of the cap. The tube wall is compressed directly therebetween. This configuration has the particular advantage of requiring fewer parts than those caps of the prior art and providing a more positive seal.

BRIEF DESCRIPTION OF THE DRAWINGS

The embodiments of this invention and their advantages can be more readily undersood by referring to the accompanying drawings in which.

DESCRIPTION OF THE PREFERRED EMBODIMENTS

Figure 1:
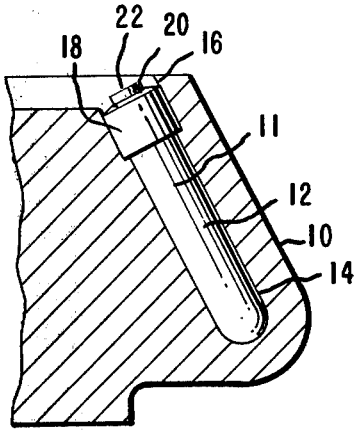
FIG. 1 is a pictorial representation of a centrifuge tube, utilizing a cap constructed in accordance with this invention, nested in a cavity of a centrifuge rotor, the rotor showing being fragmentary and partially cut away.

There is illustrated in FIG. 1 a fragmentary portion of a typical fixed angle rotor for a preparative centrifuge in which the axis 11 of the centrifuge container or tube 12 is positioned at a so-called positive angle such that the bottom portion of the tube is at a greater radial distance from the axis of rotation of the rotor 10 than the top portion. This particular arrangement is preferred to a horizontal tube orientation as is known since it reduces the separation times required. The separated material need not travel the entire axial length of the tube but need only travel a short distance dependent upon the angle of inclination of the tube.

The tube 12 is positioned within a cavity 14 which is counter bored in the upper portion as at 16 to accommodate the tube cap 18 which has a larger diameter than the tube proper. The tube cap 18, constructed in accordance with this invention, includes a nut 20 which is tightened to secure the cap tightly to the tube as will be described. A post fill screw 22 is provided such that after the cap is securely attached to the tube 12 the post fill screw facilitates complete filling of the tube with a fluid such that proper fluid support for the tube is provided during spin, i.e., the fluid, being essentially incompressible, prevents collapse of the tube.

Figure 2:
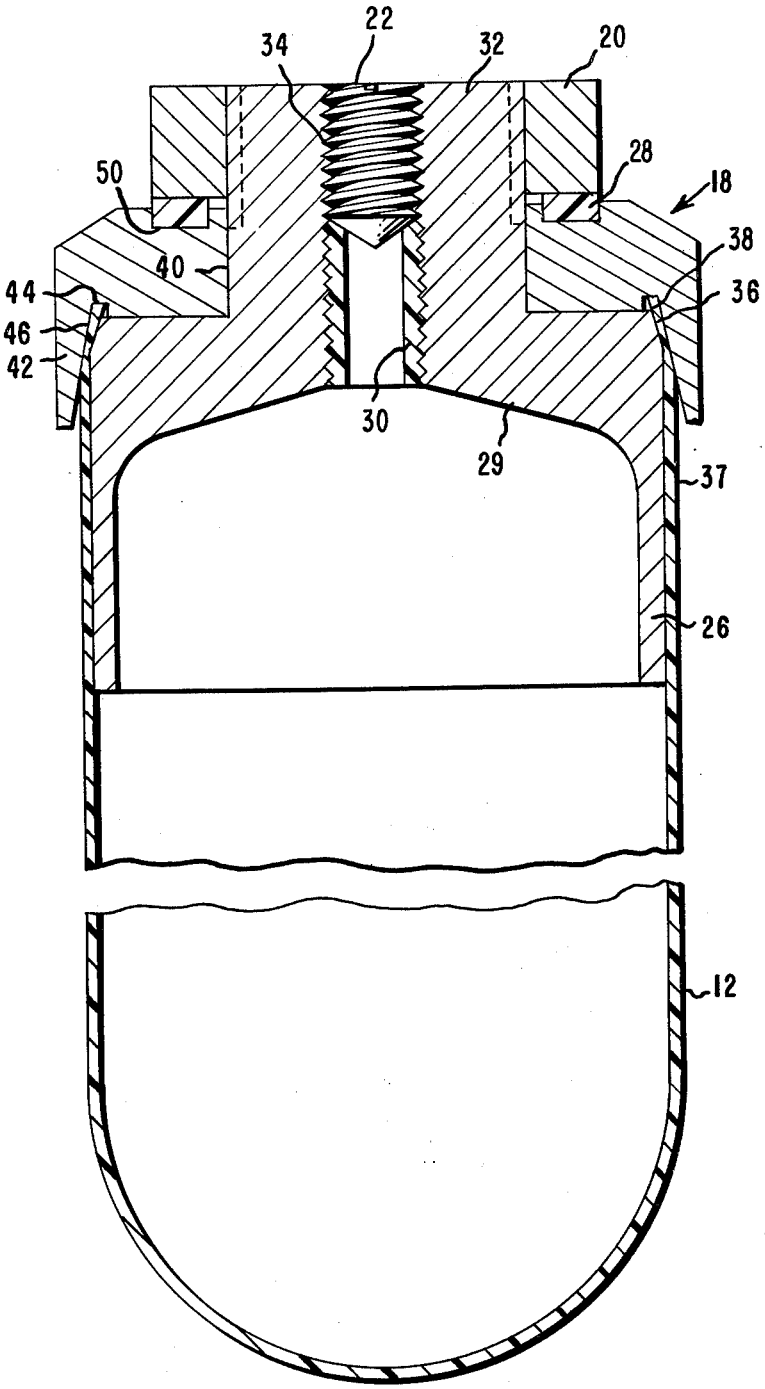
FIG. 2 is a cross-sectional elevation view of the centrifuge tube and cap illustrated in FIG. 1.

The structural details of the cap 18 are shown in greater detail in FIG. 2. In this figure it is seen that the tube 12 is closed at the bottom end and open at the top. It may be made of any suitable plastic material as is well known or it may be made of a suitable lightweight metal. The tube may be transparent, translucent or opaque; however, transparent is preferred since it permits viewing of the tube's contents.

In accordance with this invention, the cap assembly 18 includes six separate components or parts. The six parts include a plug 24, a cover or cap 18, a thrust washer 28, a hex nut 20, a post fill screw 22, and post fill screw seal 30.

Figure 3:
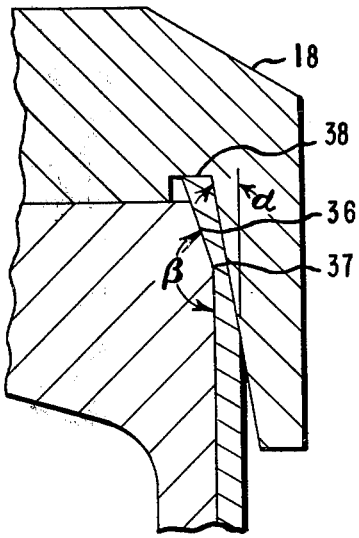
FIG. 3 is a fragmentary cross-sectional view of a portion of the centrifuge tube and cap illustrated in FIG. 2 particularly depicting the manner in which sealing is affected.

The plug 24 is a hollow cylindrical object made of a suitable light weight metal such as aluminum or the like. It is formed with a downwardly extending, integrally formed annulus or skirt 26 having an outside diameter which is about equal to or slightly less than the inside diameter of the tube 12 such that it fits snugly within the top portion of the tube. The upper portion (in the drawing) of the plug 24 is a stud 32 of reduced diameter having a central bore 34 which permits access to the interior of the tube 12. The stud portion 32, being a smaller diameter than the remainder of the plug, thus forms a shoulder portion 36 in the region of the upper lip 38 of the tube. The shoulder 36 is beveled, and in a preferred form of the invention, the bevel has an angle which is the supplement of the angle $\beta$ (FIG. 3) of approximately 15° with respect to the axis or wall 37 of the tube. No bevel at all may be used if desired or the bevel may have an angle that varies anywhere from 0° to 20°. This bevel, as will be described, cooperates with the cap 18 so as to wedge the tube wall 37 between the plug and cap and thereby compress or grip the upper portion of the tube 12 just below the lip 18. The bevel is preferred because it provides an edge or ridge 37 for positively engaging the inner wall of the tube.

To provide this wedging or gripping action, the cap 18 is in the form of an annulus having a central aperture 40 which is adapted to fit over and be slidable upon the stud 32 and to fit over the top of the shoulder 36 of the plug and tube. The cap, which also may be formed of any suitable lightweight metal such as aluminum or the like, has an integrally formed, downwardly extending annulus or skirt 42. The cap skirt 42 has an inside diameter at the upper portion thereof which is less than the outside diameter of the tube and forms at this point an annular recess 44 to accommodate the lip 38 of the tube. From this point downwardly the skirt is flared outwardly such that the inner wall of the skirt 42 has an outwardly going taper 46. The angle $\alpha$ (FIG. 3) of the taper is an acute angle preferably of about 8° with respect to the axis or wall of the tube, although the angle of this taper may, in accordance with this invention, vary anywhere from just above 0° to 15°. Angles of greater than 15° may be used, but are not preferred because the wedging action becomes more difficult. The only limitation placed on the angle $\alpha$ is that it must be less than that of the shoulder bevel (the supplement of the angle $\beta$) for the wedging action to occur.

The top of the cap 18 has an annular groove or channel 50 formed therein to accommodate a flexible, deformable thrust washer 28 which may be formed of any suitable resilient material. The outer periphery of the upper portion of the stud 32 is threaded so as to accommodate the hex nut 20. The bore 34 is similarly threaded to accommodate a threaded short tubular post fill screw seal 30. This screw seal 30 may be formed of a suitable plastic material similar to the thrust washer 28 such as polyethylene or the like and is tubular with its exterior threaded. Finally, the post fill screw 22 which is preferably made of a material other than aluminum, to reduce pitting and the like, is threaded to engage the upper portion of the bore. The fill screw typically may be made of stainless steel or other suitable material.

To use the cap assembly 18, first the plug 24 is introduced into the upper portion of the tube 12 such that the shoulder 36 is just below the lip 38 of the tube. The snug fit facilitates this and, of course, the tube preferably has already been filled with the material to be centrifuged. Next, the cap 18 is placed over the stud 32 such that its annulus 42 engages the lip 38 of the tube. The thrust washer 28 is placed in position and the hex nut threaded onto the stud 32. As the nut is tightened, the cap 18 is urged against the beveled shoulder portion 36 of the plug. As this wedging action takes place, the inside taper 46 of the annulus 42 begins to force or wedge inwardly or crimp the upper tube portion including the lip 38 of the tube 12 and causes the tube to be gripped or compressed between the tapered shoulder 36 (and particularly ridge 37) and the tapered inner wall 46 of the annulus 42. This forms an extremely effective seal which is not only mechanically strong, but also is fluid tight. A syringe may be used to finish any required filling of the tube through the bore such that the tube cavity is completely filled with fluid as preferred in centrifuge operations. To complete the operation, the seal 30 and post fill screw 22 are threaded in the bore 34 to complete the seal. The lower end of the seal 30 may be grooved to permit screwdriver manipulation.

After use, the post fill screw may be removed to sample any of the fluid as desired. Following this, the nut 20 may be removed and the cover removed. This removal is further facilitated since the inside of the cap is flared outwardly as previously described. The upper portion of the tube 12 resumes its original shape such that the plug is easily removed therefrom for use in another application or with another tube.

There has thus been described a relatively simple, secure cap assembly that is capable of securely sealing a centrifuge tube. The parts required for the cap assembly are few and the assembly provided is reusable.

I claim:

1. A closure assembly for a centrifuge tube that is open at one end and closed at the other comprising:

a plug adapted to be removably insertable into the open end of said tube, said plug defining a beveled shoulder, a cap adapted to be detachably mounted on said plug with a depending annular portion extending over said beveled shoulder and at least partially over the outer surface of the wall of said tube, the interior of said annular portion of said cap being flared with at least a part of the interior diameter of said annular portion being less than the outside diameter of said tube, and means including said cap for wedging the wall of said tube between the beveled shoulder of said plug and the flared portion said cap, thereby to form a seal for the open end of said tube.

2. A closure assembly according to claim 1 wherein the angle of said flared annular portion relative to the wall of said tube is an acute angle of less than 15°.

3. A closure assembly according to claim 1 wherein the angle of said beveled shoulder relative to the wall of said tube is less than 20°.

4. A closure assembly according to claim 1 wherein said wedging means includes a threaded stud on said plug and a nut adapted to engage said stud thereby to permit said cap and said plug to be wedged together.

5. A closure assembly for a centrifuge tube that is open at one end and closed at the other comprising:

a plug adapted to be removably insertable into the open end of said tube, said plug defining a beveled shoulder, a cap adapted to be detachably mounted on said plug with a depending annular portion extending over said beveled shoulder and at least partially over the outer surface of the wall of said tube, the interior of said annular portion of said cap being flared with at least a part of the interior diameter of said annular portion being less than the outside diameter of said tube, and means including said cap for wedging the wall of said tube between the beveled shoulder of said plug and the flared portion of said cap, thereby to form a seal for the open end of said tube, the angle of said flared annular portion being less than the angle of said beveled shoulder, both angles being measured relative to the wall of said tube.

6. A closure assembly for a centrifuge tube that is open at one end and closed at the other comprising:

a plug adapted to be removably insertable into the open end of said tube, said plug defining a beveled shoulder, a cap adapted to be detachably mounted on said plug with a depending annular portion extending over said beveled shoulder and at least partially over the outer surface of the wall of said tube, the interior of said annular portion of said cap being flared with at least a part of the interior diameter of said annular portion being less than the outside diameter of said tube, and means including said cap for wedging the wall of said tube between the beveled shoulder of said plug and the flared portion of said cap, thereby to form a seal for the open end of said tube, the angle of said flared portion relative to the wall of said tube being about 8° and the angle of said beveled shoulder being about 15°.

7. A centrifuge test tube cap for a thin flexible test tube comprising:

a stem member including a stud adapted to extend out of the mouth of the tube, said stem member including a cylindrically shaped skirt dimensioned to fit snugly within the inner surface of said test tube, said stem member also including an annular surface between said skirt and said stud slanting outwardly in the downward direction;

a crown member having an opening therein receiving said stud of said stem member and having a depending lip, said lip having a wedge-shaped cross-section with an annular inner surface slanting outwardly in the downward direction, said wedge-shaped lip of said crown member being positioned over said stem member and being thereby adapted to cause the upper edge of said flexible tube to be deformed inward against said annular slanting surface of said stem member; and means for clamping together said stem member and said crown member whereby said upper edge portion of said flexible tube is squeezed between said respective slanting surfaces of said stem member and said crown member.

8. The centrifuge test tube cap defined in claim 1 in which said clamping means includes threads formed on said stud and a threaded nut adapted to fit on said stud and tighten down an upper surface of said crown member to force said crown member toward said stem member.

9. The centrifuge test tube cap defined in claim 8 in which the crown member is provided with an upwardly facing flat surface surrounding the stud in which is mounted a thrust washer to provide a seat against which said threaded clamping nut may be tightened to cause said crown member and said stem member to move toward each other.

* * * * *